US005461872A

United States Patent [19]

Mostello

[11] Patent Number: 5,461,872

[45] Date of Patent: Oct. 31, 1995

[54] AIR SEPARATION METHOD AND APPARATUS

[75] Inventor: Robert A. Mostello, Somerville, N.J.

[73] Assignee: The BOC Group, Inc., New Providence, N.J.

[21] Appl. No.: 342,537

[22] Filed: Nov. 21, 1994

[51] Int. Cl.[6] ..... F25J 3/02

[52] U.S. Cl. ..... 62/24; 62/39

[58] Field of Search ..... 62/24, 39, 41

[56] References Cited

U.S. PATENT DOCUMENTS

| | | | |
|---|---|---|---|
| 5,036,672 | 8/1991 | Rottmann | 62/24 |
| 5,218,825 | 6/1993 | Agrawal | 62/39 |
| 5,359,857 | 11/1994 | Honda | 62/24 |
| 5,385,024 | 1/1995 | Roberts et al. | 62/39 |

*Primary Examiner*—Ronald C. Capossela

*Attorney, Agent, or Firm*—David M. Rosenblum; Larry R. Cassett

[57] ABSTRACT

An air separation method and apparatus in which air is separated by a low temperature rectification process having cooling and rectification stages for cooling air to a temperature suitable for its rectification and for distilling or fractionating the air into fractions enriched in components of the air, respectively. A process stream flowing between the cooling and distillation stages is either partially warmed or cooled and is then expanded in a turboexpander to produce a refrigerant stream. The refrigeration is recovered within the cooling stage and after the refrigerant stream has fully warmed, the refrigerant stream is drawn at subatmospheric pressure by a blower or the like and is then discharged at or above atmospheric pressure. The drawing of the air at subatmospheric pressure increases the turboexpander pressure ratio to in turn increase the amount of refrigeration that is supplied.

7 Claims, 1 Drawing Sheet

AIR SEPARATION METHOD AND APPARATUS

BACKGROUND OF THE INVENTION

The present invention relates to a method of separating air by a low temperature rectification process in which process streams composed of the air to be separated and fractions of the air that have been separated flow between cooling and distillation stages and a portion of one of the process streams, either containing air or a separated fraction of the air is used to refrigerate the process. More particularly, the present invention relates to such an air separation method and apparatus in which the refrigeration is supplied by expanding the refrigerant stream with the performance of work and after fully warming the refrigerant stream, drawing the refrigerant stream at a sub-atmosphere pressure by a blower or the like to discharge the refrigerant stream at and above atmospheric pressure.

Air is separated into its components by a variety of low temperature rectification processes. In all processes, air is compressed, cooled to a temperature suitable for its rectification is (normally at or near the dewpoint of the air) and then is introduced into the distillation stage having one or more distillation columns to separate the air into nitrogen and oxygen rich fractions.

In any type of air separation plant, there is continual heat leakage into the plant and enthalpy differences between the air feed and product streams at the warm end of the plant. Such heat leakage requires refrigeration to be supplied to the air separation plant. Refrigeration is typically supplied by partially cooling a portion of an incoming air stream or partially warming a waste stream, either rich in nitrogen or oxygen. The air stream, waste or product stream is in turn expanded with a performance of work in a machine known a turboexpander.

In order to transmit the work of expansion, the turboexpander can be coupled to an energy dissipative brake or an electrical generator, or a compressor used in the plant.

The refrigeration output of the turboexpander is related to the pressure ratio of the expansion or more specifically, the pressure ratio of the turboexpander inlet pressure and the turboexpander exhaust pressure. In order to increase the refrigeration output of the turboexpander, in some instances, the inlet pressure to the turboexpander is increased using the shaft energy output of the turboexpander to boost the pressure of the gas destined for turboexpansion. As will be discussed, the present invention provides an air separation method and apparatus in which the amount of refrigeration supplied by the turboexpander is increased by decreasing the turboexpander exhaust pressure.

SUMMARY OF THE INVENTION

The present invention provides a method of separating air by a low temperature rectification process having a cooling stage for cooling compressed air to a temperature suitable for its rectification. The process also has a distillation stage for distilling the air into fractions enriched in components of the air and process streams composed of the air and the fractions of the air flow between the cooling and the distillation stages. At least a portion of a process stream is partially warmed to form a refrigerant stream composed of at least part of the least portion of the process stream. The refrigerant stream is turboexpanded with the performance of work and refrigeration is recovered from the refrigerant stream by fully warming the refrigerant stream within the cooling stage. After the refrigerant stream is fully warmed, the refrigerant stream is drawn at a subatmospheric pressure. The pressure of the refrigerant stream is then built to at least atmospheric pressure.

In another aspect, the present invention provides an apparatus for separating air comprising a main heat exchange means for cooling compressed air to a temperature suitable for its rectification and distillation means for distilling the compressed air into fractions enriched in components of the air. The main heat exchange means are connected to the distillation means so that process streams composed of the air and the fractions of the air flow between the main heat exchange and distillation means. The main heat exchange means is configured to discharge a refrigerant stream composed of least one of the process streams after at least a portion of the one of the process streams has been partially warmed or cooled within the main heat exchange means. A turboexpander is provided for expanding the refrigerant stream with the performance of work. The turboexpander is connected to the main heat exchange means and the main heat exchange means is also configured so that the refrigerant stream fully warms within the main heat exchange means. A means is connected to the main heat exchange means for drawing the refrigerant stream at subatmospheric pressure, for building the pressure of the refrigerant stream to at least atmospheric pressure, and for discharging the refrigerant stream at the at least atmospheric pressure.

Thus, the present invention increases the inlet to exhaust pressure ratio of the turboexpander by drawing the exhaust to a subatmospheric pressure by a blower or other similar means. The blower can be driven by the turboexpander so that no additional energy is consumed in the process. Advantageously, a waste or product stream can be used as the refrigerant stream and such stream after having passed through the main heat is discharged from the air separation apparatus at atmospheric pressure. It is understood that in forming the refrigerant stream, a waste or product stream could be partially warmed within a heat exchanger other than the main heat exchanger of the plant, for instance a superheater or an air liquefier. Thereafter, the refrigerant stream would be expanded and fully warmed within the main heat exchanger.

BRIEF DESCRIPTION OF THE DRAWINGS

While the specification concludes with claims distinctly pointing out the subject matter that Applicants regard as their invention, it is believed that the invention will be better understood when taken in connection with the accompanying sole figure which is a schematic view of an air separation apparatus operating in accordance with a method of the present invention.

DETAILED DESCRIPTION OF THE DRAWINGS

Figure 1:
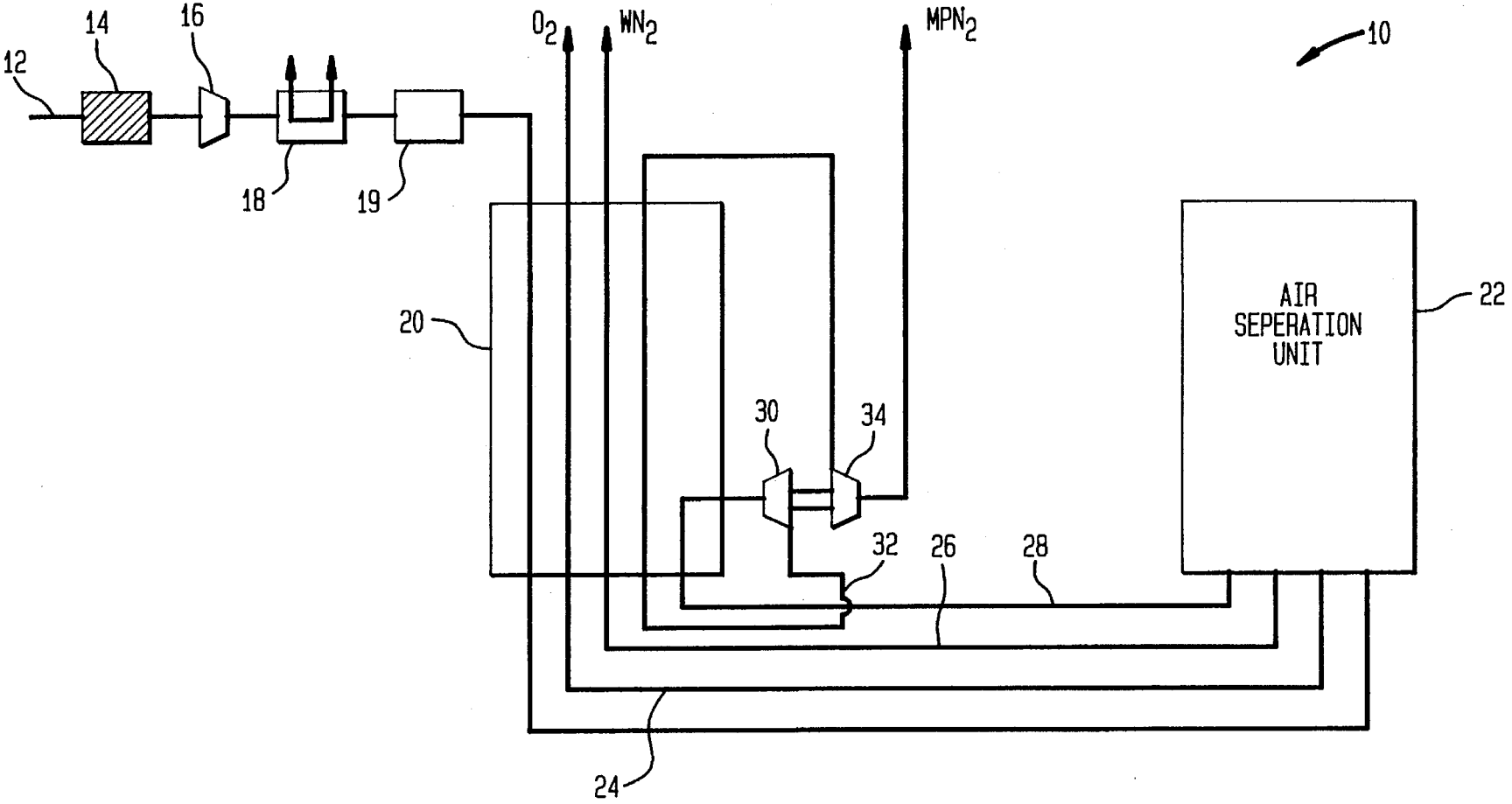

With reference to the figure, air is separated by an air separation plant or apparatus 10 operating in accordance with a method of the present invention. An incoming air stream 12 is filtered by a filter 14 to remove dust and other particulate matter in the air. Thereafter, the air is compressed by a main compressor 16. The heat of compression is removed by an aftercooler 18 and the air is then purified by a pre-purification unit 19 having adsorbent beds designed to remove water and carbon dioxide from air stream 12. Thereafter, air stream 12 is cooled within a main heat exchanger 20 to a temperature suitable for its rectification and, thus cooled, is introduced into an air separation unit 22.

Air separation unit 22 can consist of one or more distillation columns in which an ascending vapor phase is contacted with a descending liquid phase of the air to be separated. This contact can be effected on well known sieve plates or bubble cap trays or structured packing. The contact between the vapor and liquid phases causes the vapor phase to become evermore concentrated in the light elements of the air as it ascends in the column and the liquid phase to become evermore concentrated in the heavier components of the air. As a result, a nitrogen enriched tower overhead and an oxygen enriched column bottoms are produced within the distillation column.

In apparatus 10, air separation unit 22 can consist of two columns, a high pressure column connected to a low pressure column in a heat transfer relationship so that medium pressure nitrogen is produced as a tower overhead in the higher pressure column and an oxygen product is produced at a bottom region of the low pressure column. Additionally, waste nitrogen is removed from the top of the low pressure column. The present invention is not, however, restricted to such an arrangement and in fact the present invention would have equal applicability to a single column process as opposed to a multiple column process.

In the illustrated embodiment, air separation unit 22 produces an oxygen product stream 24 which is fully warmed within main heat exchanger 20. Additionally, a waste nitrogen stream 26 is likewise produced by air separation unit 22 and is fully warmed within main heat exchanger 20 Such waste nitrogen stream 26 stream being labeled $WN_2$ upon its discharge from apparatus 10. Additionally, air separation unit 22 produces a medium pressure nitrogen stream 28 which as will be discussed is used as a refrigerant stream to add refrigeration to the process.

It is to be noted that the term "fully cooled" as used herein and in the claims means fully cooled to a temperature at which air separation unit 22 operates or the cold end of main heat exchanger 20. The term "fully warmed" means warmed to the warm end of main heat exchanger 20 which in practice would be ambient, atmospheric conditions. The terms "partially warmed" and "partially cooled" mean the partial warming or cooling, respectively, to a temperature intermediate the warm and cold end temperatures of main heat exchanger 20.

Medium pressure nitrogen stream 28 is partially warmed within main heat exchanger 20 and is then turboexpanded in a turboexpander 30 to produce a refrigerant stream 32. Refrigerant stream 32 is then fully warmed within main heat exchanger 20. Refrigerant stream 32 in fully warming within main heat exchanger 20 lowers the enthalpy of the incoming air and thereby adds refrigeration to the process being conducted within apparatus 10.

In order to increase the amount of refrigeration supplied, refrigerant stream 32 is drawn by a blower 34 at a subatmospheric pressure and then is discharged at atmospheric pressure in a stream labeled $MPN_2$. Blower 34 is coupled to turboexpander 30 so that at least part of the work of expansion is recovered in powering blower 34.

It is understood that the present invention is not limited to the illustrated embodiment. For instance, the present invention would have equal applicability to an air expansion plant in which a portion of the incoming air, after having been partially cooled, were expanded to produce a refrigerant stream subsequently discharged to atmosphere. Additionally, the present invention would have applicability to a plant in which a pressurized waste nitrogen stream were utilized to supply refrigeration. Although in the illustrated embodiment, the entire medium pressure nitrogen stream 28 is utilized to supply refrigeration, only a portion of such stream might be utilized in a specific embodiment of the present invention.

As will be understood by those skilled in the art that although the present invention has been described with reference to a preferred embodiment, numerous changes, omissions and additions may be made without departing from the spirit and the scope of the present invention.

I claim:

1. A method of separating air comprising:

separating the air by a low temperature rectification process having a cooling stage for cooling compressed air to a temperature suitable for its rectification, a distillation stage for distilling the air into fractions enriched in components of the air, and process streams composed of the air and said fractions of the air flowing between said cooling and distillation stages;

forming at least one product stream enriched in one of said fractions of said air and discharging said at least one product stream from said low temperature rectification process;

partially warming or cooling at least part of a process stream to form a refrigerant stream composed of at least part of said process stream;

turboexpanding said refrigerant stream with the performance of work;

recovering refrigeration from said refrigerant stream by fully warming said refrigerant stream within said cooling stage; and after said refrigerant stream has fully warmed, drawing said refrigerant stream at subatmospheric pressure and building pressure of said refrigerant stream to at least atmospheric pressure.

2. The method of claim 1, wherein at least part of said performance of work is applied to the drawing and pressure building of said refrigerant stream.

3. The method of claim 1, wherein:

said air separation process is conducted so that said process stream is a medium pressure nitrogen stream produced from the separation of the air; and said at least part of said process stream is partially warmed within said cooling stage prior to being expanded.

4. An apparatus for separating air comprising:

main heat exchange means for cooling compressed air to a temperature suitable for its rectification;

distillation means for distilling the compressed air into fractions enriched in components of the air;

said main heat exchange means connected to said distillation means so that process streams composed of the air and said fractions of the air flow between said main heat exchange and distillation means;

said main heat exchange means configured to discharge a refrigerant stream composed of at least part of one of said process streams after at least a portion of said one of said process stream has been partially warmed or cooled within said main heat exchange means;

a turboexpander for expanding said refrigerant stream with the performance of work;

said turboexpander connected to said main heat exchange means and said main heat exchange means also configured so that said refrigerant stream fully warms within said main heat exchange means; and means connected to said main heat exchange means for drawing said refrigerant stream at subatmospheric pressure, for building pressure of said refrigerant stream to atmospheric pressure, and for discharging said refrigerant stream.

5. The apparatus of claim 4, wherein said drawing, building and discharging means comprises a blower connected to said main heat exchange means.

6. The apparatus of claim 5, wherein said blower is coupled to said turboexpander so that at least is portion of said work of expansion is applied to said blower.

7. The apparatus of claim 6, wherein:

said distillation means is configured to produce a medium pressure stream enriched in nitrogen;

said process stream comprises said medium pressure stream; and said distillation means is connected to said main heat exchange means so that said at least part of said process stream partially warms within said cooling stage.

* * * * *